US008726428B2

(12) United States Patent
Nelson

(10) Patent No.: US 8,726,428 B2
(45) Date of Patent: May 20, 2014

(54) SWIMMING POOL SKIMMER COVER

(75) Inventor: Laurence A. Nelson, Knoxville, TN (US)

(73) Assignee: P.I., Inc., Athens, TN (US)

( * ) Notice: Subject to any disclaimer, the term of this patent is extended or adjusted under 35 U.S.C. 154(b) by 483 days.

(21) Appl. No.: 13/062,356

(22) PCT Filed: Sep. 8, 2009

(86) PCT No.: PCT/US2009/056215

§ 371 (c)(1), (2), (4) Date: May 27, 2011

(87) PCT Pub. No.: WO2010/028357

PCT Pub. Date: Mar. 11, 2010

(65) Prior Publication Data

US 2012/0110728 A1 May 10, 2012

Related U.S. Application Data

(60) Provisional application No. 61/094,596, filed on Sep. 5, 2008.

(51) Int. Cl.

| | |
|---|---|
| ***E04H 4/00*** | (2006.01) |
| ***E04H 4/14*** | (2006.01) |
| ***E04H 4/12*** | (2006.01) |

(52) U.S. Cl.

CPC ..... *E04H 4/14* (2013.01); *E04H 4/1236* (2013.01)

USPC ..... 4/496; 4/507

(58) Field of Classification Search

CPC ..... E04H 4/14; E04H 4/1236

USPC ..... 4/496, 507; 138/90; 210/169

See application file for complete search history.

(56) References Cited

U.S. PATENT DOCUMENTS

| | | | | |
|---|---|---|---|---|
| 5,273,077 | A * | 12/1993 | Oropallo | 138/90 |
| 5,604,939 | A * | 2/1997 | Widener | 4/507 |
| 5,809,587 | A * | 9/1998 | Fleischer | 4/507 |
| 6,315,911 | B1 | 11/2001 | Radsky | |
| 6,966,078 | B2 * | 11/2005 | Evans et al. | 4/507 |
| 2004/0031738 | A1 | 2/2004 | Harris-Griffin et al. | |
| 2007/0262007 | A1 | 11/2007 | Pamperin | |

FOREIGN PATENT DOCUMENTS

KR 10-2007-0101070 10/2007

OTHER PUBLICATIONS

Int'l Search Report & Written Opinion issued in application No. PCT/US09/56215 (2010).

* cited by examiner

*Primary Examiner* — Tuan N Nguyen

(74) *Attorney, Agent, or Firm* — Mark J. Nahnsen; Barnes & Thornburg LLP

(57) ABSTRACT

A skimmer cover assembly includes a cover that is adapted to fit over the face flange of the skimmer or pool wall to prevent water from entering the skimmer assembly. The cover is secured to the skimmer by use of a draw bolt that is threaded at one end and includes a thumb screw or wing nut at a second end. The threaded end is adapted to be threaded into a support brace that is braced against an inside surface of the skimmer housing or to the skimmer housing itself. Tightening the draw bolt with the thumb screw draws the cover tightly against the face flange of the skimmer. The cover includes a gasket seal about its perimeter to form a watertight seal with the face flange of the skimmer. The draw bolt also has an o-ring that is positioned between the thumb screw and the cover to prevent water from leaking past the cover.

14 Claims, 4 Drawing Sheets

SWIMMING POOL SKIMMER COVER

The present application claims priority to U.S. Provisional Patent Application Ser. No. 61/094,596 filed on Sep. 5, 2008, which is herein incorporated by reference.

BACKGROUND

The present disclosure relates to covers, and particularly to skimmer covers for pool skimmers. More particularly, the present disclosure relates to a skimmer cover that is used to seal a mouth opening into the skimmer housing to prevent pool water from entering the skimmer housing. When winterizing a swimming pool, it is necessary to drain the water from the skimmer to prevent damage. Typically, water remains in the swimming pool during the winter months. Thus, it is necessary to cover the skimmer opening to prevent water from entering the skimmer.

SUMMARY

According to the present disclosure, a skimmer cover is adapted to seal a mouth opening into a pool skimmer. The skimmer cover prevents water from the pool from entering the skimmer.

In illustrative embodiments, the skimmer cover includes a cover plate that is adapted to fit over the face flange of the skimmer. The cover is secured to the skimmer by use of a draw bolt that is threaded at one end and includes a thumb screw or wing nut at a second end. The threaded end is adapted to be threaded into a support brace that is braced against an inside surface of the skimmer housing. Tightening the draw bolt with the thumb screw draws the cover tightly against the face flange of the skimmer. The cover includes a gasket seal about its perimeter to form a watertight seal with the face flange of the skimmer. The draw bolt also has an o-ring that is positioned between the thumb screw and the cover to prevent water from leaking past the cover.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
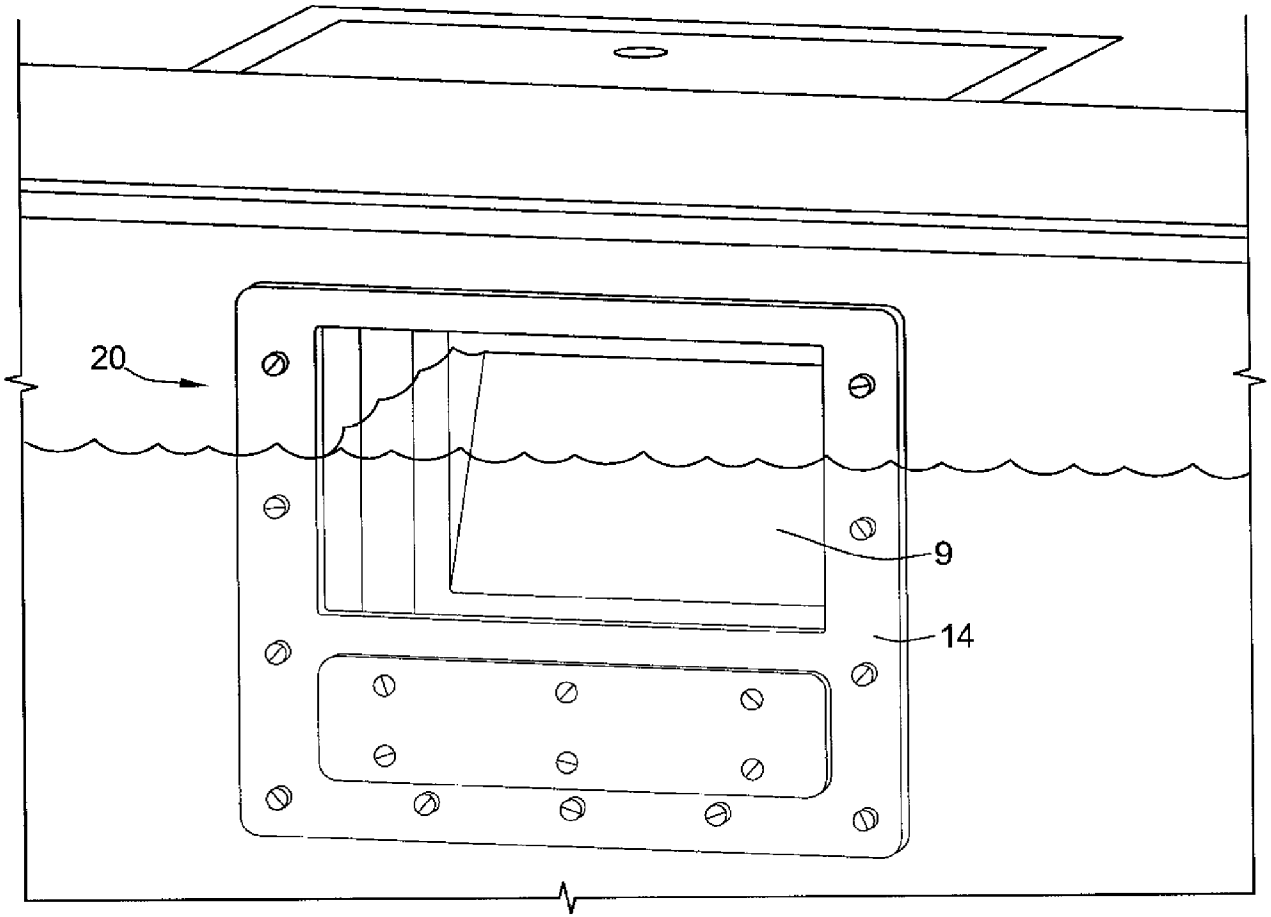
FIG. 1 is a perspective view of the side wall of a swimming pool or decorative pond having a skimmer secured to the side wall of the pool, the skimmer is formed to include an opening to allow for the flow of pool water into the skimmer and a skimmer weir wall positioned within the opening.

While the present disclosure may be susceptible to embodiment in different forms, there are shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

Figure 4:
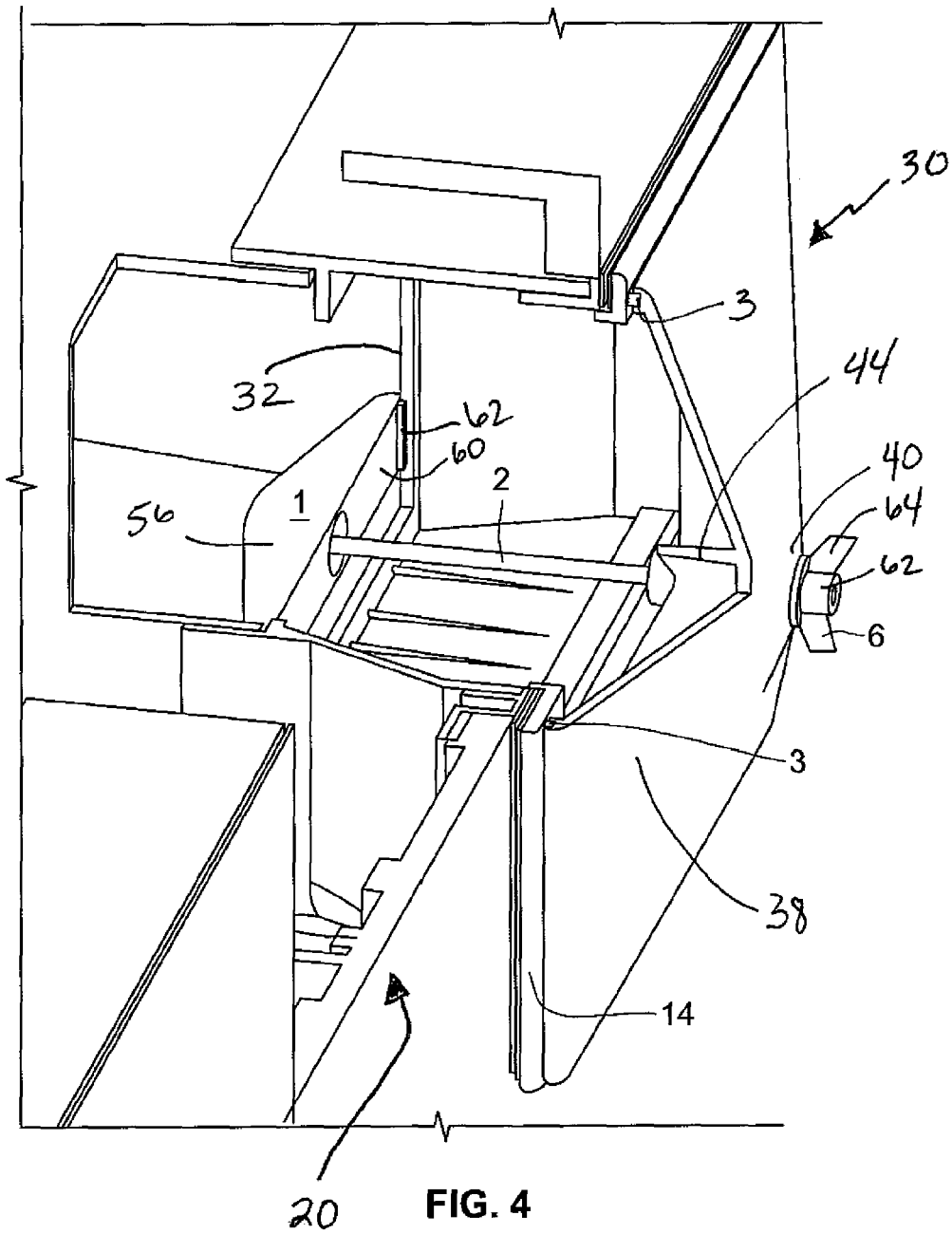
FIG. 4 is a perspective view of the skimmer cover being secured to the skimmer to seal the opening of the skimmer and showing the support brace positioned within the skimmer housing and the draw bolt securing the cover to the support brace to firmly seal the cover to the face flange of the pool skimmer.

Conventional skimmer covers or winter covers depend upon a seal between the cover 4 and the face flange 14 of a skimmer 20, as shown in FIG. 1. This method does not address the issue of seepage between the face flange 14 and liner material. The skimmer cover assembly 30 of the present disclosure not only seals against face flange 14 of skimmer 20 but also exerts a force against face flange 14 by anchoring support brace 1 against an inside edge 32 of the skimmer body 8 and compressing the assembly by use of a draw bolt 2, as shown in FIG. 4. Using this arrangement, skimmer cover 4 compresses face flange 14, outer gasket 13, pool liner material 11, inner gasket 12, and pool wall 10 together, as shown in FIG. 4. The compression force aids in preventing water from leaking behind face flange 14.

Figure 2:
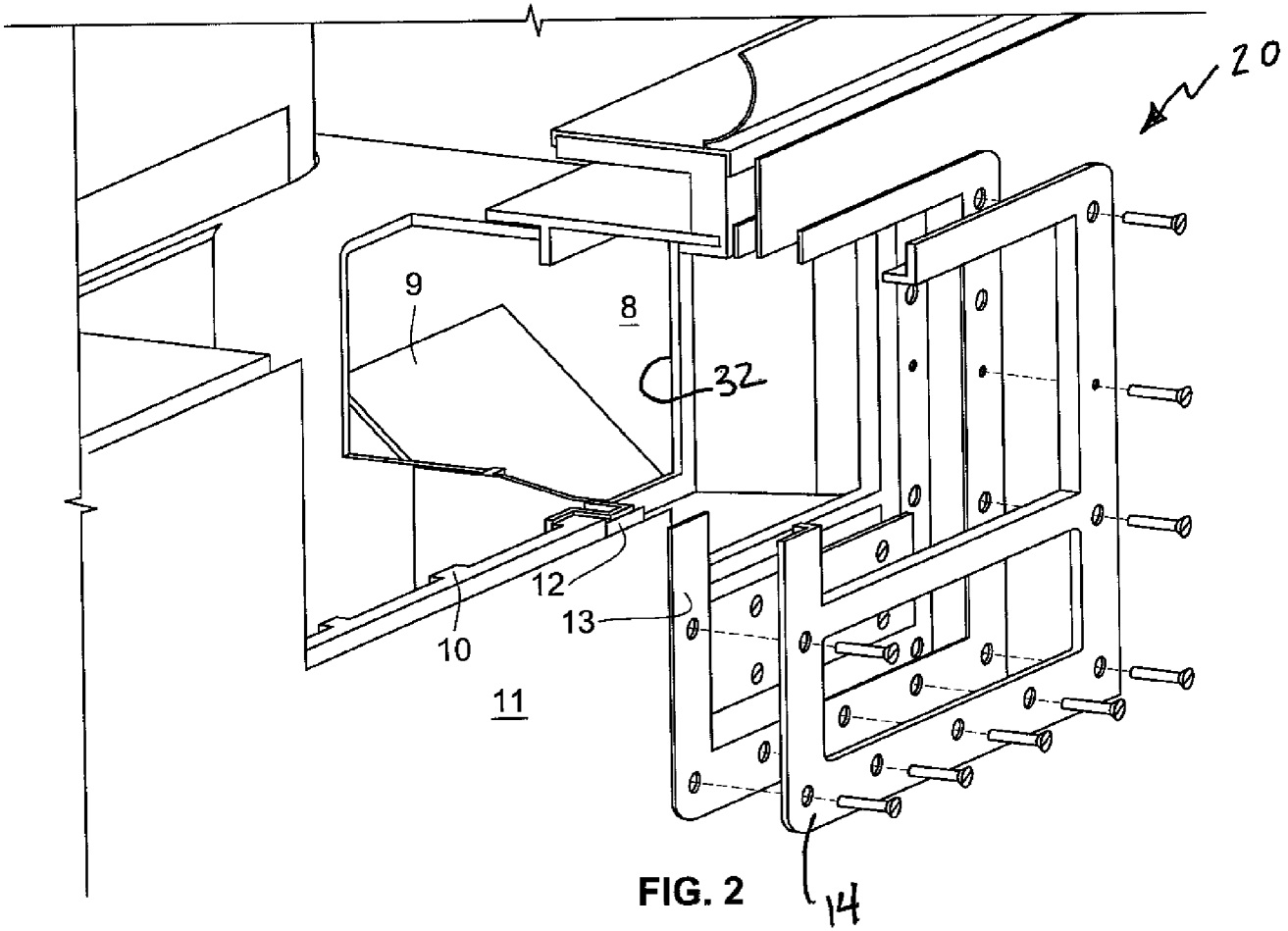
FIG. 2 is an exploded perspective view of the skimmer coupled to the wall of the pool showing the face flange of the skimmer being secured to the skimmer housing through the wall of the pool by use of fasteners and also showing an outer gasket, the pool liner and an inner gasket positioned behind the face flange, and further showing portions of the pool wall and skimmer housing cut away to show the weir wall within the skimmer housing.

This arrangement not only develops a superior seal against the face flange 14 but makes certain that the seals 12, 13 under the face flange are compressed to insure a better seal between the pool liner 11 and gaskets 12, 13, as shown in FIG. 2. While a wing nut is shown, it is contemplated that other types of fasteners could be used to draw the cover 4 to the face flange 14 of the pool skimmer 20, such as, for example a cam-style of lever that is flipped to one side to draw cover 4 against face flange 14 of skimmer 20. While the skimmer cover assembly 30 is shown coupled to a pool skimmer 20, it is contemplated that the skimmer cover assembly 30 could be used in a variety of applications, such as decorative ponds.

Figure 3:
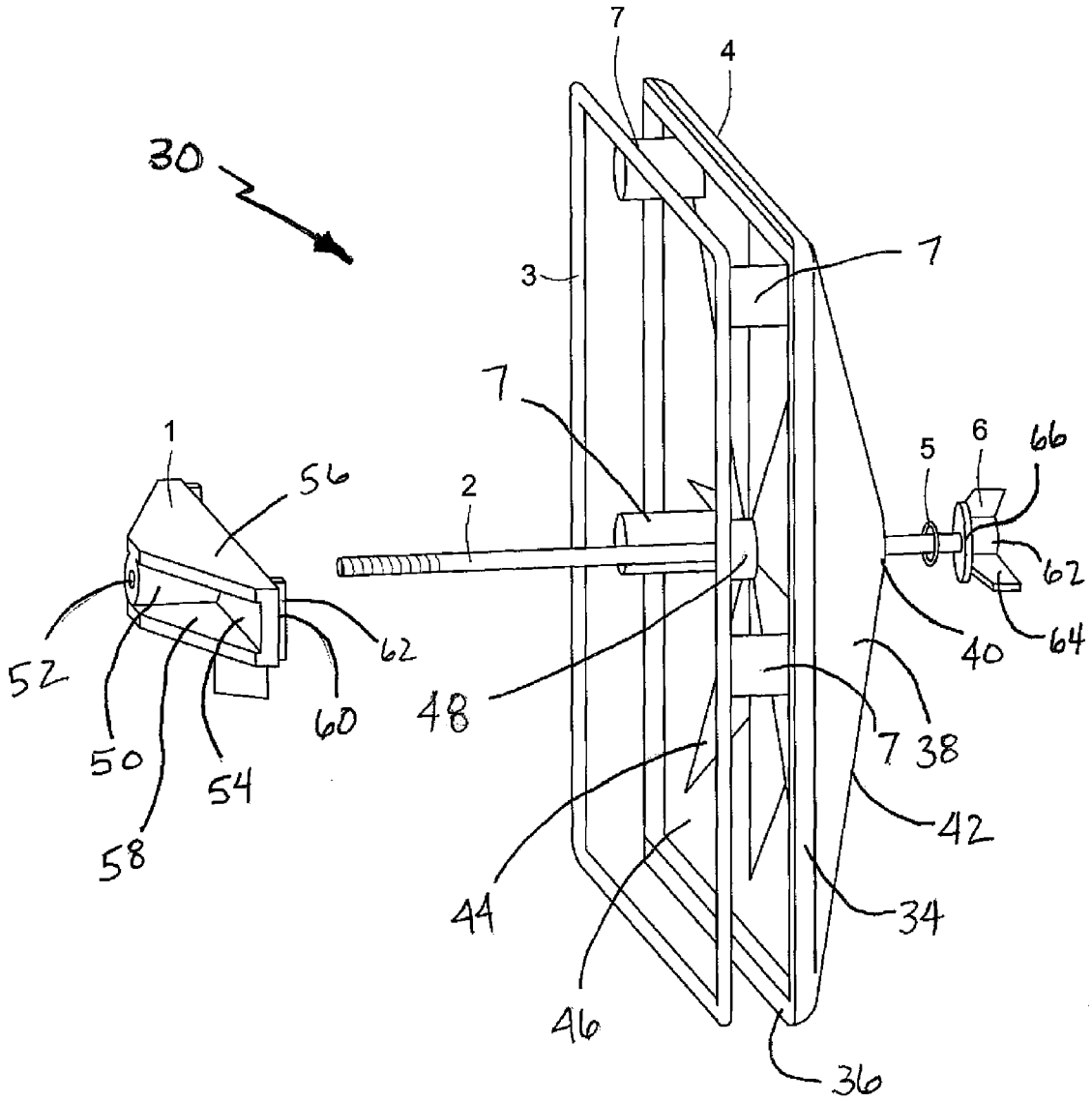
FIG. 3 is an exploded view of the skimmer cover that is used to seal the opening of the skimmer to prevent water from entering the skimmer housing, the skimmer cover including a cover molded with an o-ring groove about its perimeter and a square shaped o-ring that is adapted to fit in the groove, and also showing a draw bolt that extends through the cover and threads into a support brace, the draw bolt including a wing nut opposite the threaded end and further including a second o-ring on the shaft of the draw bolt to seal the draw bolt to the cover.

The skimmer cover assembly 30 consists of multiple parts, as shown in the exploded view of FIG. 3. The skimmer cover assembly 30 includes a cover 4 that is molded with an O Ring groove and means to align it with the face flange 14. The alignment means can be in the form of raised posts 7 or a continuous lip, for example, as shown in FIG. 3. O-ring or gasket 3 fits within o-ring groove and seals cover 4 against the face flange 4. Alternatively, cover 4 can be made wider than face flange so that cover 4 engages the pool liner directly.

Brace 1 provides an anchor point inside the skimmer body. Brace 1 is wide enough to engage one or more surfaces within the skimmer housing to maintain the position of the brace 1. Draw bolt 2 is threaded into the brace 1 by turning the wing nut 6. As the draw bolt 2 is turned, the cover 4 is pulled against the face flange 14 to compress all the components (gaskets, pool liner, etc.) between the cover 4 and the skimmer body. A second O ring 5 is positioned on draw bolt 2 and is used to create a seal between the cover 4 and the draw bolt 2.

Cover 4 includes an annular flange 34 having a face 36 that may include a groove to accept gasket 3. Gasket 3 can be an O-ring type of gasket or a flat-type of gasket. Cover 4 also includes four sloped walls 38 that extend from annular flange 34 to peak 40. The intersection of the walls 38 with each other form edges 42. This arrangement allows the force applied by wing nut 6 to be transmitted evenly to gasket 3 and face flange 14 of skimmer 20.

Cover also includes ribs 44 that extend outwardly from an inside surface 46 of cover 4 that are used to strengthen the cover 4 to prevent flexing when force is applied by draw bolt 2. Cover 4 further includes central boss 48 that has a central aperture (not shown) that the draw bolt 2 passes through. Central boss 48 and ribs 44 also assist in the transfer of the force of draw bolt 2 to annular flange 34 so that even pressure is applied to gasket 3.

Brace 1 is configured to be positioned within the skimmer 20 and includes a central tube 50 that includes an annular bore 52. Annular bore includes threads to accept draw bolt 2 so that draw bolt 2 can be threaded into brace 1. Brace 1 also includes an end wall 54 and side walls 56, 58. Side walls are coupled to central tube 50 along their center line and are triangular shaped to assist in transferring the force of draw bolt 2 to end wall 54.

End wall 54 of brace 1 includes a face 60. Face 60 is configured to engage an inner surface of the skimmer 20 to allow draw bolt 2 and wing nut 6 to apply a force to cover 4. Face 60 includes two outwardly extending flanges 62. Flanges 62 are configured to assist in maintaining the position of the brace 1 within the skimmer 20 so that brace 1 does not move out of position when tightening wing nut 6. As previously discussed, brace 1 can be a stand alone piece or can be molded into the skimmer 20. Brace 1 of the skimmer cover assembly 30 can be configured to fit a variety of skimmers 20 that are currently in the marketplace.

Wing nut 6 can be molded onto draw bolt 2 to make them a one piece unit. Wing nut 6 includes a central body 62, and three wings 64 that extend from the central body 62. Wing nut 6 also includes a flange 66. Flange 66 is configured to apply a force against o-ring seal 5 to prevent water from entering cover 4 through the interface between flange and cover 4.

This iteration of the design uses the brace as the anchor within the skimmer body cooperating with the weir wall opening flange but it is also possible to place the anchor in the basket area or to supply an anchoring means as part of the skimmer body by molding an anchor means into the skimmer body.

In use, an installer first positions the brace 1 within the housing of the pool skimmer. Once brace 1 is positioned within the skimmer housing, the threaded draw bolt 2 is passed through the cover 4 and threaded into the brace 1. Wing nut 6 is then turned to draw cover 4 to face flange 14. Gasket 3 is positioned between cover 4 and face flange 14 to create a water tight seal. Wing nut 6 includes a flange that compresses o-ring 5 between wing nut 6 and cover 4 to create a water tight seal. The wing nut 6 applies a constant pressure to the cover, which, in turn, applies a force to the face flange 14, gaskets 12, 13 and liner 11 of the pool. The cover 4 is pyramid shaped to cause an equal pressure to be applied to gasket 3. Cover 4 can be dimensioned to fit any shape skimmer and can be designed as a universal kit for use on skimmers from various manufacturers.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the invention are desired to be protected. The applicants have provided description and figures which are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A skimmer cover assembly adapted to cover a mouth that opens into a skimmer assembly, the mouth including a face flange that is adapted to allow pool water to flow into the skimmer assembly, the skimmer assembly including a top opening that allows access to the inside of the skimmer assembly, the skimmer cover assembly comprising:

a cover having an interior side and an exterior side, the interior side is configured to face toward the skimmer assembly, the cover including a rim;

a seal member configured to be positioned between the rim of the cover and the face flange of the skimmer assembly;

a support brace configured to be inserted through the mouth of the skimmer assembly and engage a surface within the skimmer assembly to retain the support brace within the skimmer assembly; and a draw bolt adapted to pass through the center of the cover and engage the support brace, the draw bolt including a head that is positioned on the outside of the cover to permit the draw bolt to be rotated with respect to the support brace to draw the cover towards the skimmer assembly to compress the seal member to prevent water from passing between the cover and the face flange of the skimmer assembly, wherein the cover, the support brace, and draw bolt can all be installed to the skimmer assembly through the mouth without requiring a user to access the inside of the skimmer assembly through the top opening.

2. The skimmer cover assembly of claim 1, wherein the rim includes a groove configured to accept seal member.

3. The skimmer cover assembly of claim 2, wherein the cover includes alignment posts configured to align the cover with the skimmer assembly.

4. The skimmer cover assembly of claim 3, wherein the cover includes sloped walls that extend from the flange to a peak to transfer the force applied by the draw bolt to the seal member and the face flange of the skimmer assembly.

5. The skimmer cover assembly of claim of claim 4, wherein the cover includes a series of ribs that extend outwardly from an inner surface to limit flexing of the cover.

6. The skimmer cover assembly of claim 1, wherein the support brace includes an annular bore with threads configured to accept draw bolt.

7. The skimmer cover assembly of claim 6, wherein the support brace also includes an end wall and side walls, the side walls are configured to assist in transferring the force of the draw bolt to the end wall.

8. The skimmer cover assembly of claim 7, wherein the end wall of the brace includes a face, the face being configured to engage an inner surface of the skimmer assembly to allow the draw bolt to apply a force to the cover.

9. The skimmer cover assembly of claim 8, wherein the face includes two outwardly extending flanges configured to assist in maintaining the position of the brace within the skimmer assembly.

10. A skimmer cover assembly configured to cover the mouth of a skimmer assembly coupled to a pool having a pool wall and having a top opening, the skimmer cover assembly comprising:

a cover configured to engage the skimmer assembly or the pool wall surrounding the skimmer assembly, the cover including an rim;

a seal configured to be positioned between the rim of the cover and the skimmer assembly; and a support brace configured to be inserted through the mouth of the skimmer assembly and engage an interior surface within the skimmer assembly to retain the support brace within the skimmer assembly a draw bolt configured to engage and be rotatable with respect to the support brace to allow the draw bolt to draw the cover towards the skimmer assembly to compress the seal member to prevent water from passing between the cover and the face flange of the skimmer assembly, wherein the cover, the support brace, and draw bolt can all be coupled to the skimmer assembly through the mouth without requiring a user to access an inside of the skimmer assembly through the top opening.

11. The skimmer cover assembly of claim 10, wherein the annular rim includes a groove configured to accept seal.

12. The skimmer cover assembly of claim 11, wherein the cover includes alignment posts configured to align the cover with the skimmer assembly.

13. The skimmer cover assembly of claim 12, wherein the cover includes sloped walls that extend from the annular flange to a peak and transfer the force applied by the draw bolt to the seal.

14. The skimmer cover assembly of claim of claim 13, wherein the cover includes a series of ribs that extend outwardly from an inner surface of the cover to limit flexing of the cover.

* * * * *